United States Patent [19]

Bodine

[11] Patent Number: 4,693,325

[45] Date of Patent: Sep. 15, 1987

[54] SONIC DRILL EMPLOYING ORBITING CRANK MECHANISM

[76] Inventor: Albert G. Bodine, 7877 Woodley Ave., Van Nuys, Calif. 90503

[21] Appl. No.: 848,945

[22] Filed: Apr. 7, 1986

Related U.S. Application Data

[63] Continuation-in-part of Ser. No. 725,648, Apr. 22, 1985, Pat. No. 4,615,400.

[51] Int. Cl.[4] ..... E21B 7/24

[52] U.S. Cl. ..... 175/55; 175/56; 175/107

[58] Field of Search ..... 175/55, 56, 107, 343, 175/371, 394

[56] References Cited

U.S. PATENT DOCUMENTS

| | | | |
|---|---|---|---|
| 4,023,628 | 5/1977 | Bodine | 175/56 |
| 4,271,915 | 6/1981 | Bodine | 175/56 |
| 4,366,988 | 1/1983 | Bodine | 175/55 |
| 4,403,665 | 9/1983 | Bodine | 175/394 |
| 4,527,637 | 7/1985 | Bodine | 175/55 |
| 4,553,443 | 11/1985 | Rossfelder et al. | 175/55 |
| 4,603,748 | 8/1986 | Rossfelder et al. | 175/55 |

*Primary Examiner*—Stephen J. Novosad
*Assistant Examiner*—William P. Neuder
*Attorney, Agent, or Firm*—Edward A. Sokolski

[57] ABSTRACT

A drive shaft is rotatably mounted in a housing having a predetermined mass. This drive shaft has an eccentric portion at the output end thereof, this eccentric portion forming a crank arm. A drill bit is mounted on suitable bearings on the output end of the shaft adjacent to the eccentric crank arm portion. The drive shaft is rotatably driven causing the crank arm to generate sonic energy which is limited in amplitude by the crank throw reacting against the inductive inertia of the housing mass. The sonic energy thus generated causes the drill bit to orbit around at a sonic frequency to effect drilling action so as to produce a bore hole having a somewhat oversize diameter limited however in accordance with the housing's mass reactance and the throw of the crank arm.

7 Claims, 5 Drawing Figures

SONIC DRILL EMPLOYING ORBITING CRANK MECHANISM

This application is a continuation-in-part of my application Ser. No. 725,648 filed Apr. 22, 1985 now U.S. Pat. No. 4,615,400.

This invention relates to sonic drills and more particularly to such a device employing a sonic oscillator with a bearing housing carrying a drive shaft having an eccentric output end forming a crank arm which drives the drill bit in a cycloidal quadrature fashion.

In my application Ser. No. 725,648 of which the present application is a continuation-in-part, a sonic drilling system is described which employs a spherical drilling bit. In this device sonic energy in a cyclodial quadrature vibration pattern is first generated in a vibratory drill housing assembly by means of a sonic oscillator employing an eccentrically weighted rotor. The sonic energy is transmitted directly from the drill housing assembly to the drill bit to cause precession of the bit around the bottom of the drill bore in a cycloidal fashion. The drill bit is free to tip and to rotate on the sonic drill assembly in response to the energy transmitted thereto by virtue of a spherical ball and socket bearing by means of which the bit is coupled to the drill assembly. With this type of orbiting mass oscillator for generating the sonic drive energy, the periodic drive force is developed through the centrifugal force reaction generated in the oscillator bearing and housing by virtue of the restraint which the bearing provides in confining the mass to its orbiting path. Thus, in this type of force generation, the oscillator mass must travel around a substantial orbit in order to generate the necessary periodic centrifugal force to vibrate the entire housing for cyclic drive at the bit.

Such operation is schematically illustrated in FIG. 1 which shows mass M being rotatably driven on shaft S in an orbiting path indicated by arrow O. The rotation of eccentric mass M develops a periodic centrifugal force F in bearing B which force is coupled to housing H in which bearing B is supported. This cyclic force is then delivered from housing H to bit D which is coupled to the housing. Thus, in this type of oscillator device, the bearing B and housing H provide the direct vibratory output to the drill bit, with the cyclic movement of H having little influence on the path in space of M. Thus, the resulting cyclic movement of B can be relatively large without substantially reducing the centrifugal force output generated by the mass M. The bit can continue to deliver side cutting force even when lateral vibration of the housing is large.

Referring now to FIG. 2 the cyclic force generator of the present invention is schematically illustrated. In this device the housing H has drive shaft S rotatably mounted therein through a bearing B. An eccentric portion at the output end of shaft S forms a relatively short crank arm E which is coupled to the drill bit D. The eccentric crank arm E provides an orbiting excursion of drill bit D with vibratory force reaction F being generated in bearing B working against the inertia of H, and which is reactively transferred to the bit in turn. In the prior art type of orbiting mass oscillator of the system as shown in FIG. 1, the orbit of housing H and along with it that of drill bit D which is driven by the housing is not closely limited and can become quite large if the system should encounter a soft formation which offers little resistance. This could result in a bore hole region having a local diameter much larger than to be desired. On the other hand, in the device of the present invention, as illustrated in FIG. 2, the amplitude of the orbiting excursion of drill bit D is limited by the reactive constraints of the system and more particularly by the throw of crank arm E backed up by the inertia of the housing H. This is in view of the fact that the mass M of housing H in the device of the present invention as illustrated in FIG. 2 is given a reactive vibratory force which is in phase opposition or 180 degrees out of phase with the force F imparted to the drill bit. Thus, the force and particularly the vibratory stroke impartd to the housing is subtractive from that imparted to the drill bit while in the prior art these two forces are additive. Moreover, the bit cannot vibrate and bore wider than the stroke of the crank. Further, in the device of the present invention, the sonic energy is not transferred through the housing H to the drill bit and thus constraints on this housing motion by the surrounding mass of drill mud has no deleterious effect on the operation of the system as compared with the prior art orbiting mass oscillator housing system.

Both systems employ the sonic inductive reactance of mass to accomplish the equivalent of a constant voltage A.C. generator, i.e. substantially constant cyclic force output value and responding with variable stroke, but importantly in quite different ways. In FIG. 1 masses M and H must necessarily vibrate vigorously so as to provide a direct drive inductance in the form of very active inductively vibratory mass because the bit D is directly connected. The housing H has to shake in order to activate the bit. On the other hand in the present invention the mass M presents sonic reactance in the form of a fulcuum type of seismic inertia the small vibration of which assures the opposed crank motion of the bit. Both drill systems tend to give substantially constant force, and the stroke is subjective to rock hardness. With the present invention the stroke is however further subjective to the crank eccentricity as explained.

It is further to be noted that the cycloidal precession of the spherical bit creates a pressure wave in the mud annulus therearound which undesirably dissipates energy and holds the bit off from the work face. In the system of the present invention in view of the 180 degree phase difference between the forces and vibratory motion generated in housing H and the drill bit, a sonic pressure surge is generated in the mud by virtue of the cyclic vibration of the relatively large surface area housing H which is opposite to that generated by the bit D, these phase-opposite pressure surges tending to neutralize each other. The system is thus a sonic di-pole providing acoustic decoupling of the vibratory bit surrounded by mud, thus allowing great freedom of cyclic bit force, even though the relatively larger housing vibrates only slightly.

It is therefore an object of this invention to provide a sonic drill in which the orbiting excursions of the bit are limited to provide a bore hole slightly larger than the bit diameter.

It is a further object of this invention to provide a sonic drilling device employing a fixed crank lever mechanism between the bit and the mass of the drill housing such that the crank mechanism is constrained by the impedance of such mass so as to deliver cycloidal force concentrated in the drill bit.

It is a further object of this invention to minimize the generation of sonic pressure pulses in the mud environment during sonic drilling operations.

It is still another object of this invention to provide a sonic drilling device in which an oscillator housing is employed which is relatively stationary such that the drill bit is assured of substantially the full stroke provided by a driving crank arm mechanism.

Other objects of the invention will become apparent as the description proceeds in connection with the accompanying drawings of which:

Figure 3:
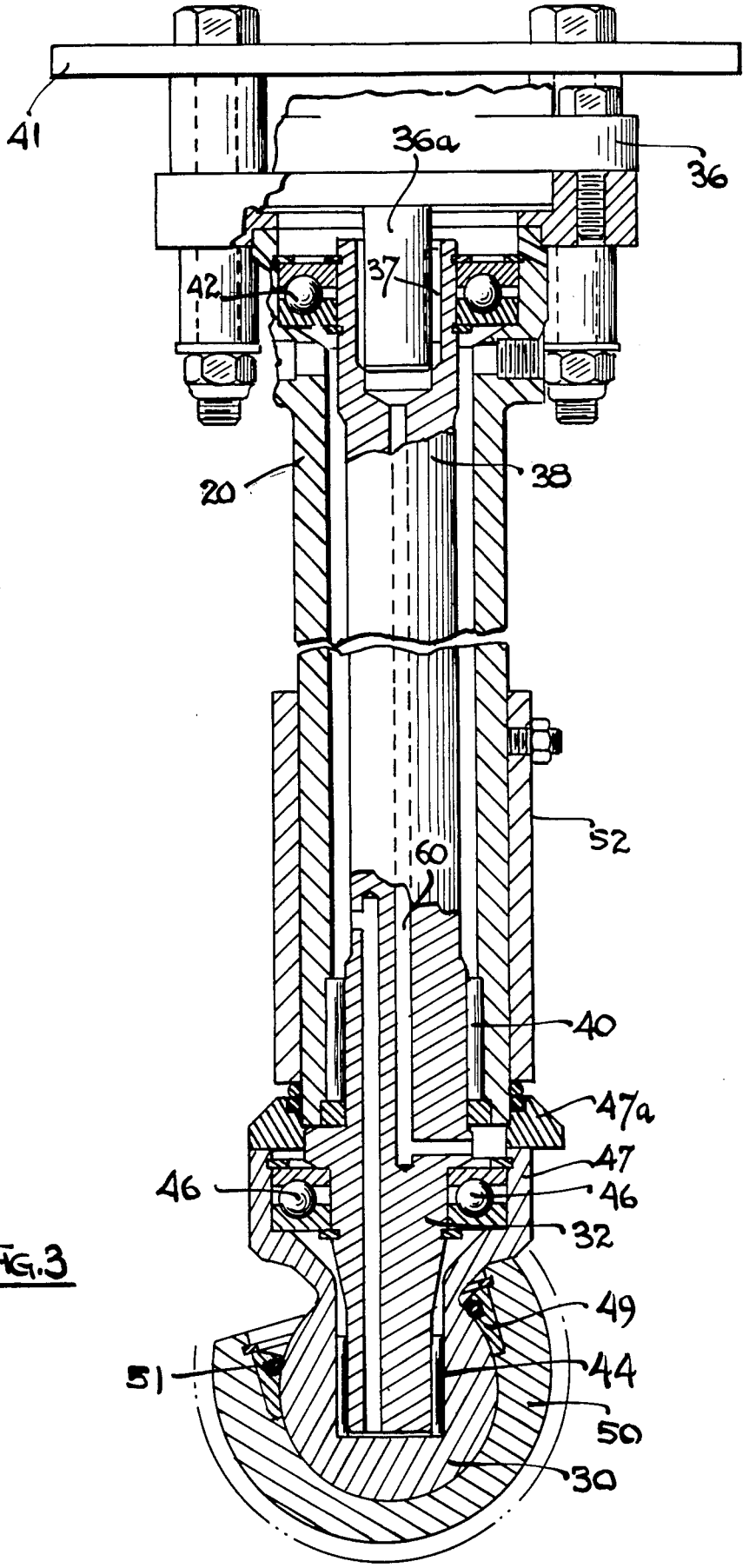
FIG. 3 is a cross sectional view illustrating a first embodiment of the invention.

Referring now to FIG. 3, a first embodiment of the invention is illustrated, this embodiment being implemented as a hand held rock ripper. Spherical bit 50 is mounted for universal movement on a ball socket joint formed between its inner surface and ball member 30. This spherical bit and its ball socket mounting structure is similar to that described in my application Ser. No. 725,648 of which the present application is a continuation-in-part. Drive shaft 38 is rotatably mounted in housing 20 on sleeve bearing 40 and pilot thrust bearing 42. The drive shaft 38 is rotatably driven by means of standard hydraulic drive motor 36, the drive shaft 36A of which is coupled to the drive shaft 38 through spline 37. The output drive end of shaft 38 has an eccentric portion 32 integrally formed therewith which forms a crank arm. Thus, as can be seen, crank arm portion 32 is eccentric with respect to the longitudinal axis 60 of the drive shaft thereby forming the crank arm. Ball element 30 is supported on the eccentric crank portion 32 by means of sleeve bearing 44 and thrust bearing 46 in bit carrier 47 having sliding contact on seal ring 47*a*, the eccentric crank portion 32 thus being permitted to rotate relative to the ball along with its associated drive shaft 38. Bit 50 is retained to ball member 30 by means of ring shaped retainer member 49, a resilient "O" ring 51 being provided to retain grease in the bearing formed between the ball member and the spherical bit and to prevent contaminants from entering this area.

In operation, drive shaft 38 is rotatably driven at a predetermined speed to cause the eccentric portion 32 to generate oscillatory quadrature vibration by virtue of its eccentric crank arm. This eccentric cyclic force causes the bit 50 to orbit around relative to housing 20 at the sonic frequency of vibration. Added mass is provided for housing 20 by means of sleeve member 52. The mass impedence of housing 20 and sleeve 52 tends to hold bearing 40 steady so that the crank arm 32 effects a maximum orbit of bit 50. At the same time, the hand held housing 20 experiences minimum shaking due to this mass impedence.

It is to be noted that if the bit should become lodged in a bore hole, this will not stall the motor in view of the fact that the crank action will merely swing the housing 20 around in a circle determined by the eccentricity of crank arm portion 32 of the drive shaft. Such swinging action generates a particularly large periodic force on the bit tending to loosen it from the bore hole. While the stroke of the bit will vary depending on the load, the cyclic force normally tends to be constant in view of the effect of the mass provided by housing 20 and sleeve 52.

Figure 1:
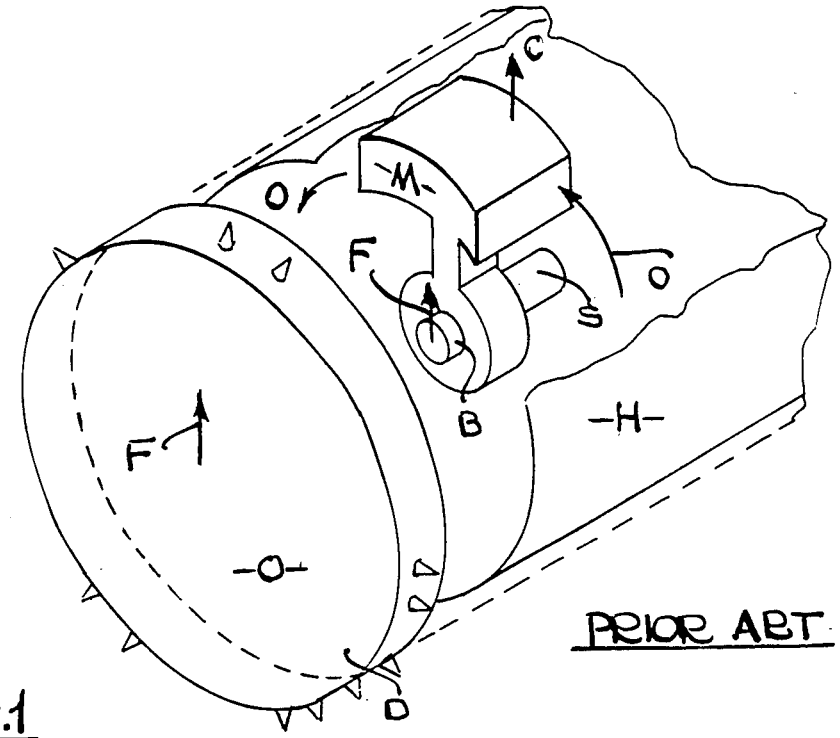
FIG. 1 is a schematic drawing illustrating the operation of prior art sonic drills.
Figure 2:
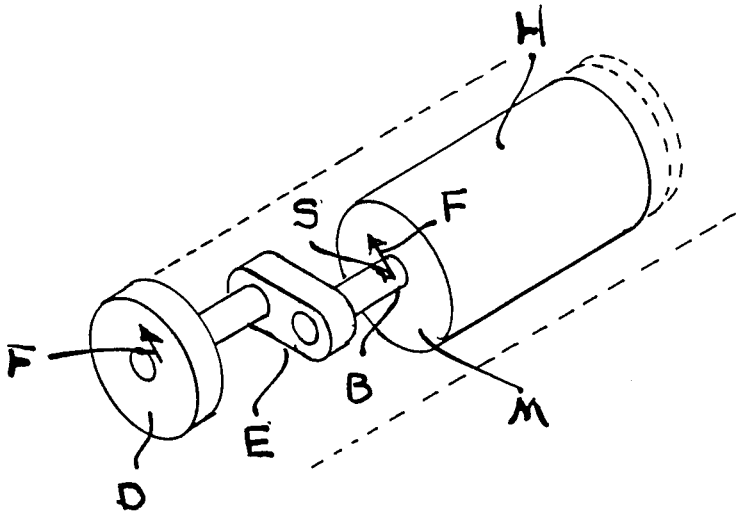
FIG. 2 is a schematic illustration illustrating the operation of the sonic drill of the present invention.
Figure 4:
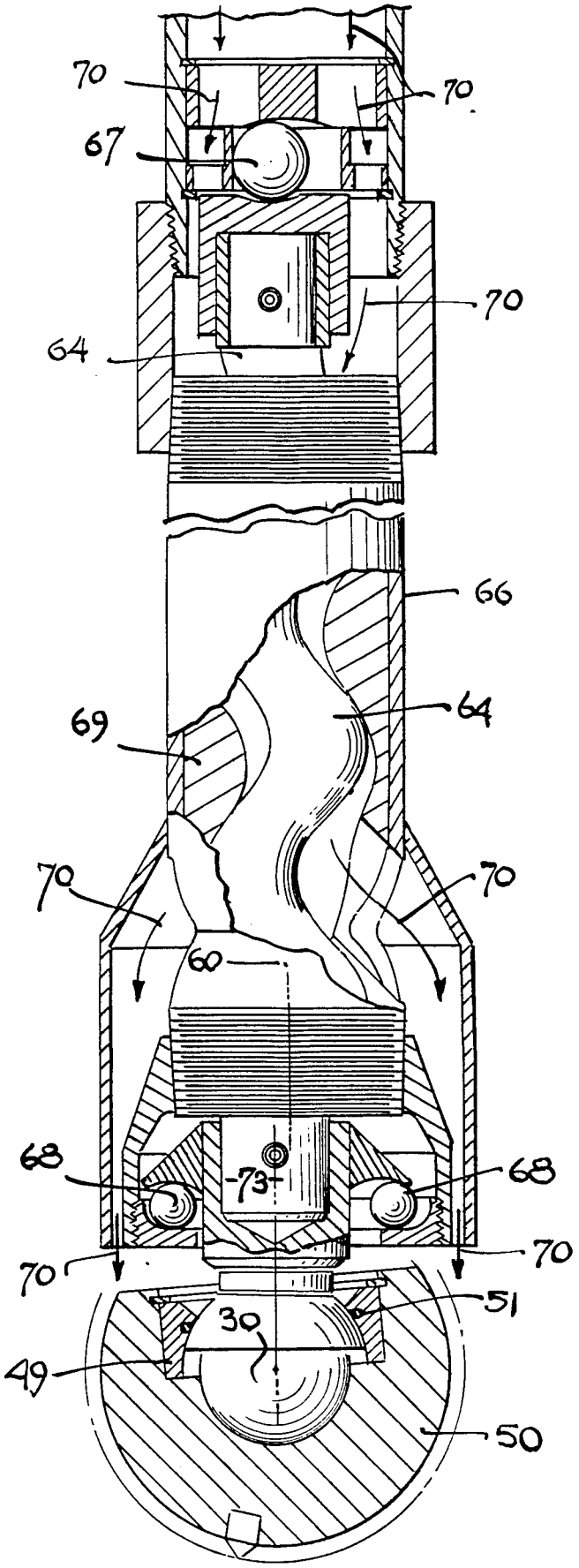
FIG. 4 is a cross sectional view of a second embodiment of the invention.

Referring now to FIG. 4 a second embodiment of the invention primarily for down hole usage is illustrated in cross section. This embodiment employs a Moyno screw type oscillator which employs a screw type rotor 64 which is rotatably supported in housing 66 by means of thrust ball bearing assemblies 67 and 68. Rotor 64 is rotatably driven in screw shaped stator 69 by means of a mud stream which is flowed past the rotor as indicated by arrows 70. This implementation is suitable for use in a drill for drilling a well and includes a spherical bit 50 universally supported on ball member 30 by means of retainer 49 as in the previous embodiment. The Moyno type device shown herein is described for example in my U.S. Pat. No. 4,261,425 in connection with FIG. 2 thereof.

As for the previous embodiment, screw shaped "drive shaft" 64 has an end portion 73 which is eccentric relative to the longitudinal axis 60 of the stator. This provides a crank arm because the rotor 64 precesses around in its stator 69. This precessional cyclic motion generates a cycloidal drive force which causes the bit 50 to orbit around the well bore in cyclical fashion. The mud stream indicated by arrows 70 washes down past the bit and brings cuttings up around the annulus surrounding the tool. The thrust bearing 68 serve to keep rotor 64 in place with the tool operational at times when the bit is not bearing against the work material.

Figure 5:
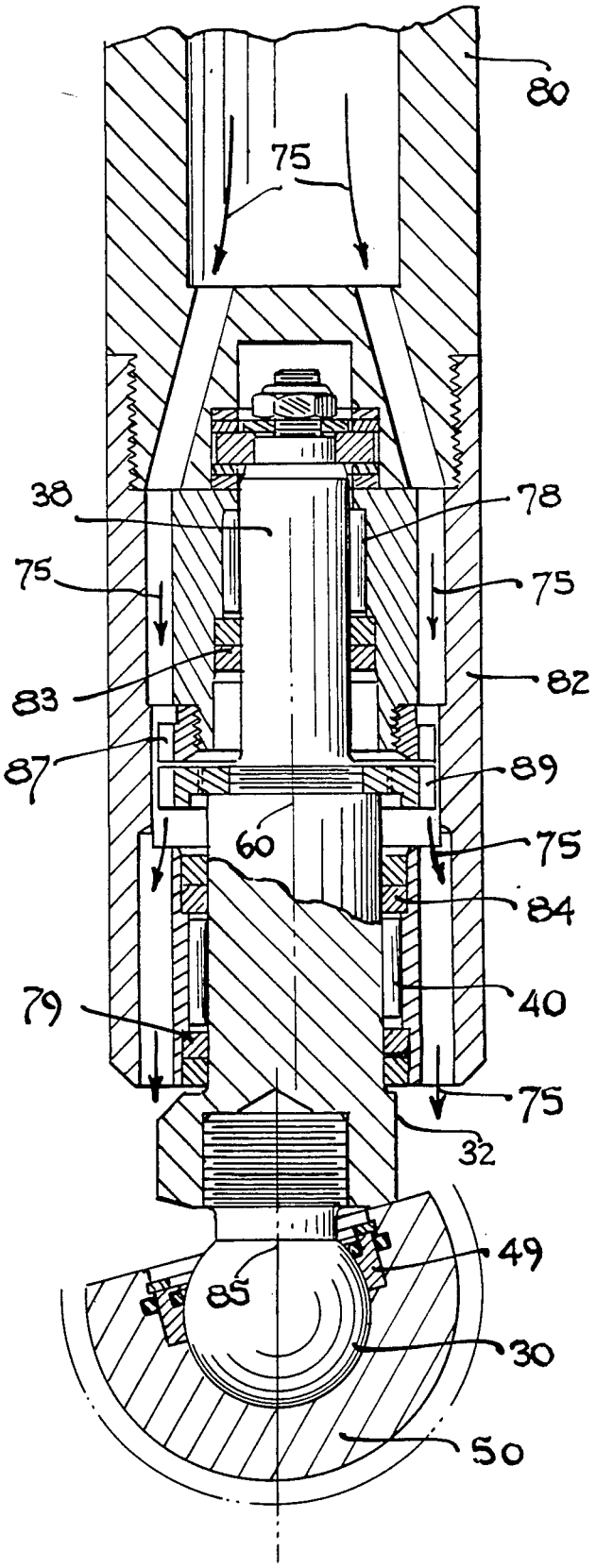
FIG. 5 is a cross sectional view of a third embodiment of the invention.

Referring now to FIG. 5 a further embodiment of the invention is illustrated in cross section. This embodiment is suitable for use in a down hole well drill and operates similarly to the previous embodiments except for the fact that a turbine drive is employed for the drive shaft and its associated crank mechanism. Oscillator housing 82 is threadably attached to drill casing or pipe 80. Rotatably supported within housing 82 on inner housing portion 82*a* by means of needle bearings 40 and 78 is drive shaft 38 which at its driving end has an eccentric portion 32 which forms a crank arm having its longitudinal axis 85 displaced from the longitudinal axis 60 of the drive shaft. Attached to drive shaft 38 is a mud turbine 89 which is rotatably driven by the mud stream indicated by arrows 75. Such a mud turbine is described in connection with FIG. 6 of my U.S. pat. No. 4,266,619. Fluid seals 79, 83 and 84 are provided to keep debris out of the grease packed annular cavities around the shaft bearings. A spherical bit 50 is supported for universal motion on ball member 30 by means of retainer ring 49 as for the previous embodiments. The mud stream indicated by arrows 75 is fed through nozzle blades 87 and rotatably drives turbine 89 which in turn rotatably drives drive shaft 38 along with its associated eccentric crank portion 32, thereby generating sonic energy which is transferred to the bit to effect orbital cutting action thereof, as in the previous embodiments.

It is to be noted that typically the eccentricity of the crank arm is relatively small, e.g. the distance between axis 60 and axis 85 can be of the order of $\frac{1}{4}$ of an inch. Limiting the crank arm in this fashion limits the orbital path of bit 50 so as to avoid cutting an overly wide bore hole particularly when drilling in relatively soft formations.

While the invention has been described and illustrated in detail, it is to be clearly understood that this intended by way of illustration and example only and is not to be taken by way of limitation, the spirit and scope of the invention being limited only by the terms of the following claims.

I claim:

1. A sonic drilling device comprising:

a housing having inertia;

a drive shaft mounted for rotation in said housing and having an eccentric portion on one end thereof forming an effective crank arm;

a drill bit supported for universal motion on the end of said crank arm; and means for rotatably driving said drive shaft at a speed such as to generate sonic vibrational energy in said shaft;

said energy being transferred through said crank arm to said bit and causing said bit to orbit relative to said housing inertia at said sonic frequency thereby effecting drilling action limited in accordance with the throw of the crank arm.

2. The drilling device of claim 1 wherein said drill bit is mounted on said shaft in a ball and socket bearing.

3. The drilling device of claim 1 wherein the mass for rotatably driving said shaft comprises a turbine and means for feeding a liquid stream through said turbine to drive said turbine.

4. The drilling device of claim 1 wherein said drive shaft is screw shaped, said housing having a screw shaped inner wall portion in which the drive shaft is rotatably mounted, and means for feeding a liquid stream through the drive shaft to rotatably drive said shaft.

5. The device of claim 1 wherein the mass of the housing is substantially greater than that of the drill bit such that the drill bit is caused to vibrate at a greater amplitude than the housing.

6. The device of claim 1 wherein said drilling device is employed to drill a bore hole, said bore hole having mud therein in contact with said housing, the housing being vibrated in phase opposition to the drill bit such that pressure surges generated in the mud by the housing tend to neutralize pressure surges generated by the bit.

7. The device of claim 6 wherein the eccentricity of the drive shaft is of the order of magnitude of the difference between the diameter of the bore hole and the diameter of the drill bit.

* * * * *